US007084814B2

(12) United States Patent
Chen et al.

(10) Patent No.: US 7,084,814 B2
(45) Date of Patent: Aug. 1, 2006

(54) PLANAR INVERTED F ANTENNA

(75) Inventors: Jun-Chia Chen, Chang Hua Hsien (TW); Hsiang-Jui Lin, Kaohsiung Hsien (TW)

(73) Assignee: Uniwill Computer Corp., Chungli (TW)

( * ) Notice: Subject to any disclaimer, the term of this patent is extended or adjusted under 35 U.S.C. 154(b) by 0 days.

(21) Appl. No.: 10/667,433

(22) Filed: Sep. 23, 2003

(65) Prior Publication Data

US 2005/0062654 A1 Mar. 24, 2005

(51) Int. Cl.
*H01Q 1/24* (2006.01)

(52) U.S. Cl. ..... 343/700 MS; 343/702

(58) Field of Classification Search ..... 343/700 MS, 343/702, 795, 846, 848, 850
See application file for complete search history.

(56) References Cited

U.S. PATENT DOCUMENTS

| | | | | |
|---|---|---|---|---|
| 6,597,317 | B1 * | 7/2003 | Talvitie | 343/700 MS |
| 6,639,560 | B1 * | 10/2003 | Kadambi et al. | 343/700 MS |
| 6,809,689 | B1 * | 10/2004 | Chen | 343/700 MS |
| 6,819,287 | B1 * | 11/2004 | Sullivan et al. | 343/700 MS |
| 6,831,607 | B1 * | 12/2004 | Hebron et al. | 343/700 MS |
| 6,836,246 | B1 * | 12/2004 | Kadambi et al. | 343/700 MS |
| 6,956,530 | B1 * | 10/2005 | Kadambi et al. | 343/702 |

* cited by examiner

*Primary Examiner*—Tuyet Vo
*Assistant Examiner*—Jimmy Vu
(74) *Attorney, Agent, or Firm*—Alan D. Kamrath; Nikolai & Mersereau, P.A.

(57) ABSTRACT

The present invention is related to a planar inverted F antenna (PIFA), which the antenna portion is allocated on a quality conductive metal element within the electronic unit. The antenna portion and the metal element are incorporated into a single component.

6 Claims, 4 Drawing Sheets

PLANAR INVERTED F ANTENNA

FIELD OF INVENTION

The present invention is related to a structured planar inverted F antenna (PIFA). An antenna portion is allocated on a metal element, which is used for enhancing strength and rigidity of the casing structure. The antenna portion and the metal element in the electronic unit are incorporated into a single component. The metal element was already located in the electronic unit, thus no extra consideration needed for room reserving. Moreover, the electronic unit has electric conduction, which is capable of grounding the antenna portion. The area of the electronic unit is vast, therefore enhancing grounding, performance, and stability.

BACKGROUND OF THE INVENTION/PRIOR ART

With wireless communication technology maturing, wireless communication product is becoming an indispensable communication tools nowadays. With wireless local area network (WLAN) catching on with LAN, firms are adapting wireless technology on PC peripherals, at the same time applying on home appliance as well. In the foresaid wireless communication product antenna is an essential element for transmitting and receiving wireless signals. The function of antenna is to convert the electromagnetic wave radiation energy of propagate media and the energy of transceiver. There is a discontinuous interface between transceiver and antenna with antenna and propagate media during the process of energy conversion. Therefore, the design of antenna is accordance with the characteristic of the two interfaces, so that the energy transferring path is continuous. Hence, the signal can smoothly be transmitted and received.

PIFA is one of the antennae on the market. PIFA was named by the appearance of the side structure, which was similar to an inverted F. The operating length of PIFA is a quarter of operating wavelength. Furthermore, the structure includes a metal ground plate, which reduces the sensitivity in the module. PIFA only need the metal conductor with desired feed and the position of short to the ground plate, consequently, the manufacturing cost is lower. PIFA can be soldered on the print circuit board (PCB). If the metal conductor is sheet-like, surface-mount device (SMD) elements can be used to attain the design of concealing the appearance of antenna.

Current electronic products on the market with PIFA built-in introduced the following shortcomings:

1. Hard to fix position, which frequently needs some extra screws, soldering, or twin adhesive, result in extending working hours.
2. Grounding of antenna is not up to par, affecting the performance of transmitting, receiving and stability.
3. Using a standalone PIFA, an extra reserving room is needed for antenna, thus, further time in R&D and room spacing is wasted.

In virtue of the abovementioned shortcomings and other reasons, a need exists for the present invention.

SUMMARY OF THE INVENTION

The present invention is related to a structured planar inverted F antenna (PIFA). The electronic product currently on the market is seeking faster data processing power and more compact, hence, inner spacing of the product is an important issue. The present invention uses a metal element which is used for enhancing strength and rigidity of the casing structure, and design the area of the antenna portion in advance so that the metal element and the antenna portion incorporate as a whole. The metal element can serve as a grounding, also stabilizing the signal while transmitting and receiving.

DETAILED DESCRIPTION OF THE PREFERRED EMBODIMENTS

Figure 1:
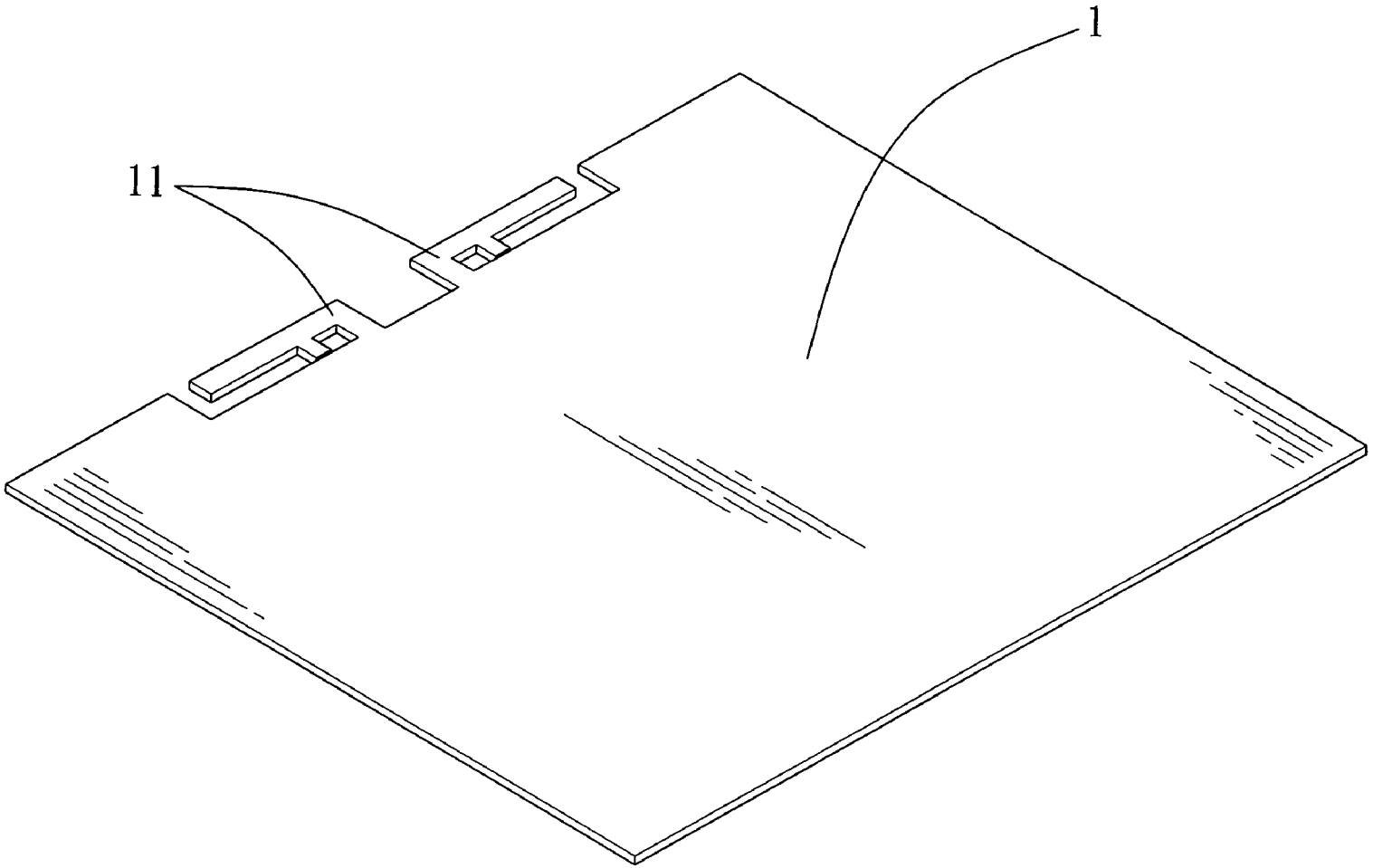
FIG. 1 is a 3-D embodiment of the present invention.

Referring to FIG. 1, which is a 3-D embodiment of the present invention. The structured PIFA comprising a conductive material with quality rigidity of metal 1, on which the antenna portion 11 was located. The antenna portion 11 formed on one side of the metal element 1 and the metal element 1 incorporate with the antenna portion 11 as a whole.

The antenna portion 11 operates at a quarter wavelength, thus resembles a PIFA. The antenna portion 11 engages with metal element 1, which acts as a broad surface for grounding. The metal element 1 stabilizes the signal while transmitting and receiving through a band of specific wavelength, diminishing the collision with other bands. Hence, the possibility of data loss and noise decreased.

Figure 2A:
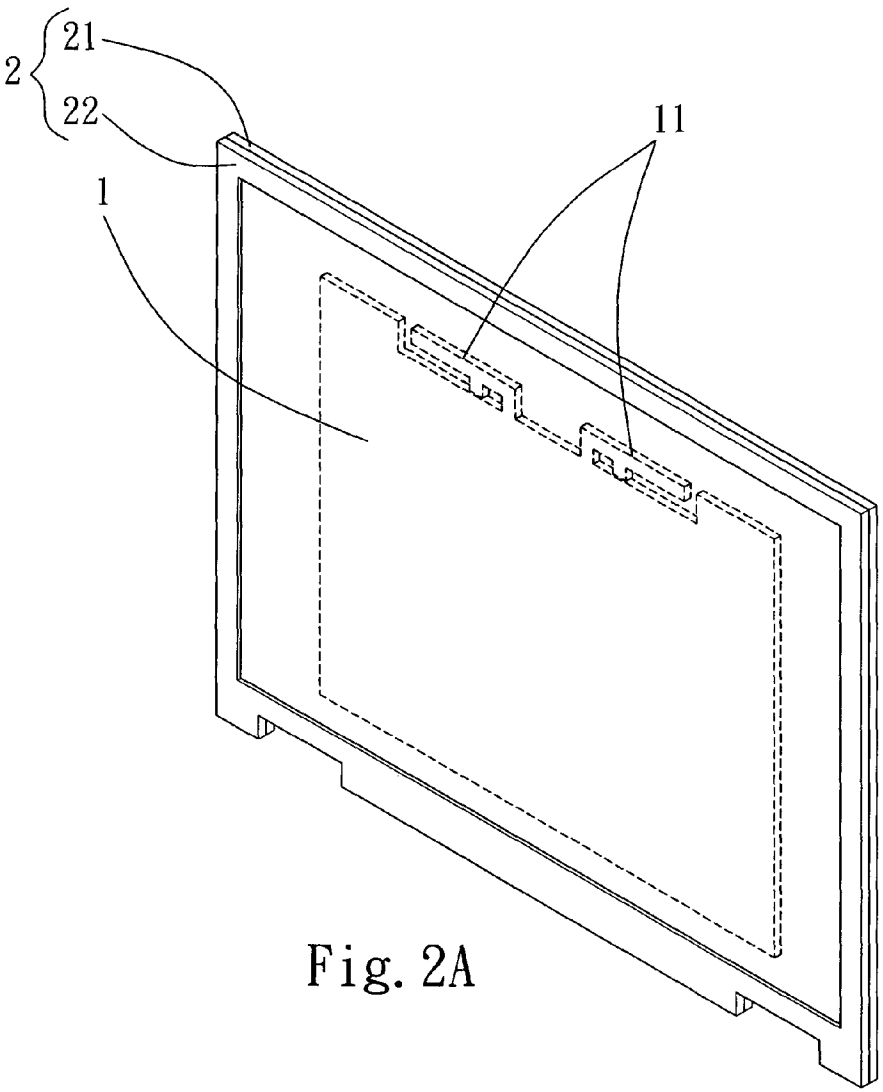
FIG. 2A is a first preferred embodiment of the present invention.

Shown in FIG. 2A, which is a first preferred embodiment of the present invention. The metal element 1 is located in a LCD monitor frame 2. The LCD monitor frame 2 comprising a front cover 21 and a rear cover 22. Firms mostly use a metal plate for enhancing rigidity, which the casing structure of LCD monitor frame 2 lacks. The present invention exploits a side of metal element 1 as the area for locating the antenna portion 11 and the metal element 1 incorporate with the antenna portion 11 as a whole. Hence, the electronic unit is capable of transmitting and receiving electromagnetic wave.

Figure 2B:
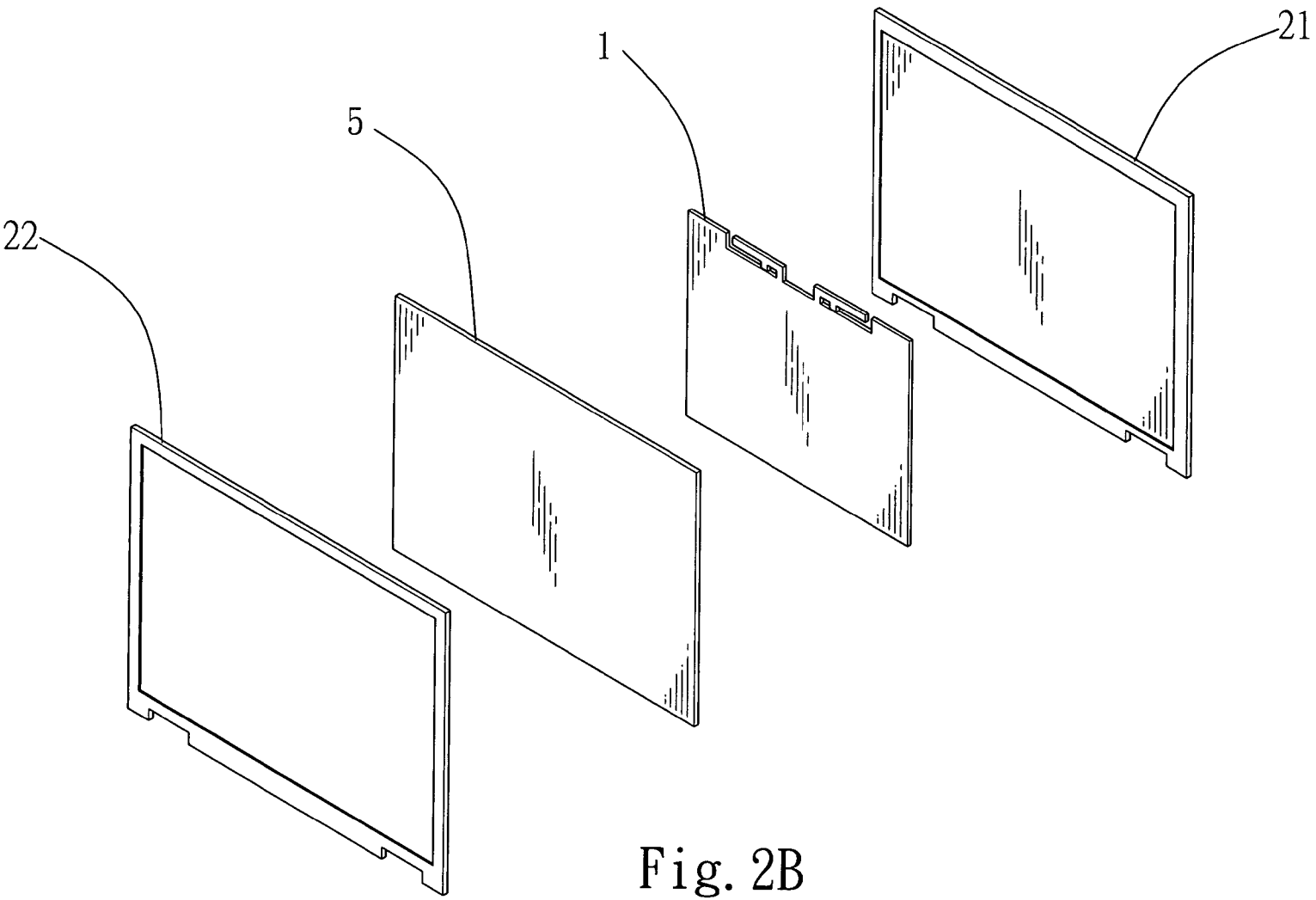
FIG. 2B is an exploded view of the first preferred embodiment of the present invention.

Referring to FIG. 2B, which is an exploded view of the first preferred embodiment of the present invention. The metal element 1 lies between LCD monitor 5 and front cover 21, while LCD monitor 5 and metal element 1 lies between front cover 21 and rear cover 22. Front cover 21 and rear cover 22 can interlock with each other, when front cover 21 and rear cover 22 interlock, metal element 1 and LCD monitor 5 are in fixed position.

Figure 3:
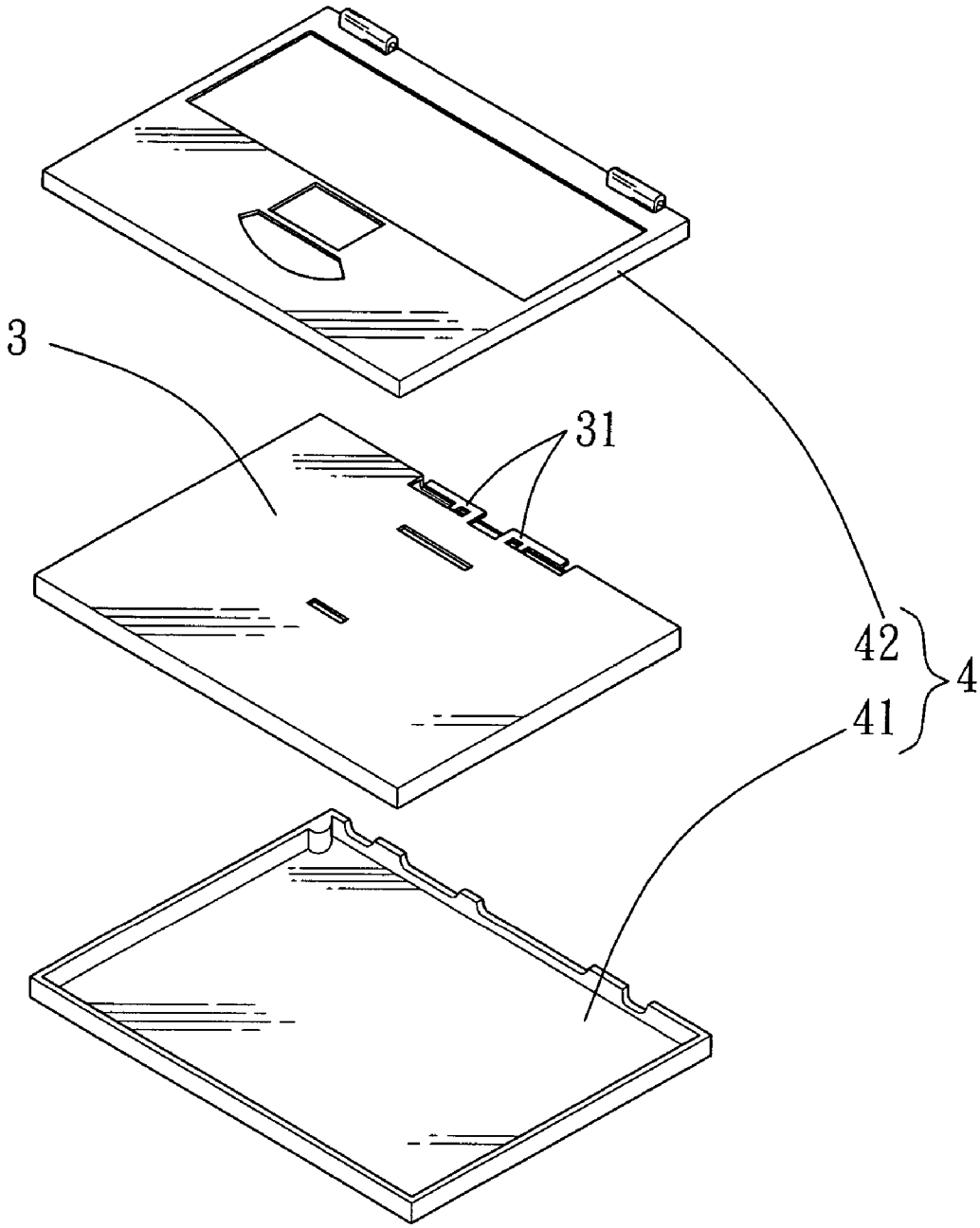
FIG. 3 is a second preferred embodiment of the present invention.

Referring to FIG. 3, which is a second preferred embodiment of the present invention. The difference with the first preferred embodiment is the shape and position of metal element 3. The metal element 3 is allocated in seat 4 of an electronic unit. Foresaid metal element 3 is a frame structure for protecting the electronic element located in seat 4. The seat 4 comprising an upper frame 41 and a lower frame 42 and interlock with each other. Reserving an area on metal element 3 for locating the antenna portion 31, moreover, the antenna portion 31 and the metal element 3 incorporate with the antenna portion 31 as a whole.

In accordance with one aspect of the present invention: the metal element 1, 3 incorporate with the antenna portion 11, 31 as a whole, furthermore, the antenna portion 11, 31 is located on any metal component such as metal frame or metal plate. Which particular electronic unit the antenna portion is located on is no concern of the present invention, hence, the present invention is not limited to any particular location and electronic unit for the antenna portion.

The features of the present invention conclude as follows:

1. The antenna portion 11, 31 and metal element 1, 3 incorporate together as a whole, eliminating the extra screws, soldering, or twin adhesive, thus saving working hour and lowering expenditure.
2. The antenna portion 11, 31 and metal element 1, 3 incorporate together as a whole, therefore an extra reserving room no more needed for the antenna, sparing extra room for other electronic elements.
3. The antenna portion 11, 31 and metal element 1, 3 incorporate together as a whole, which are all made of conductive materials. The antenna portion 11, 31 engages with metal element 1, 3 which acts as a broad surface for grounding. The metal element 1, 3 stabilizes the signal while transmitting and receiving through a band of specific wavelength, ebbing error bit rate and noise.

Although the present invention has been described with reference to preferred embodiments thereof, it is apparent to those skilled in the art that a variety of modification and changes that may be made without departing from the scope of the present invention which is intended to be defined by the appended claims.

What is claimed is:

1. A planar inverted F antenna (PIFA) apparatus, comprising:

a metal grounding member having a substantially planar portion for secure coupling to an electronic unit; and, at least one peripherally projecting F antenna portion integrally formed with said metal grounding member, said F antenna portion projecting in substantially coplanar manner from a periphery of said substantially planar portion of said metal grounding member, wherein said metal grounding member is formed with a rigid metal plate configuration defining an edge portion bounding said substantially planar portion, said F antenna portion extending outward from said edge portion.

2. A planar inverted F antenna (PIFA) apparatus comprising:

a metal grounding member having a substantially planar portion for secure coupling to an electronic unit; and, a plurality of peripherally projecting F antenna portions integrally formed with said metal grounding member, each said F antenna portion projecting in substantially coplanar manner from a periphery of said substantially planar portion of said metal grounding member;

wherein a pair of said F antenna portions extend from a common edge portion of said metal grounding member to be disposed in laterally spaced manner one relative to the other.

3. A planar inverted F antenna (PIFA) apparatus comprising:

a metal grounding member having a substantially planar portion for secure coupling to an electronic unit; and, at least one peripherally projecting F antenna portion integrally formed with said metal grounding member, said F antenna portion projecting in substantially coplanar manner from a periphery of said substantially planar portion of said metal grounding member;

wherein said metal grounding member is captured within an electronic unit selected from the group consisting of: a desktop personal computer device, a notebook personal computer device, a tablet personal computer device, and a personal digital assistant device.

4. An apparatus having a planar inverted F antenna (PIFA) device, comprising:

an electronic unit having first and second housing members;

a metal grounding member having a substantially planar portion captured between said first and second housing members of said electronic unit; and, at least one peripherally projecting F antenna portion integrally formed with said metal grounding member, said F antenna portion projecting in substantially coplanar manner from a periphery of said substantially planar portion of said metal grounding member to be secured to said electronic unit thereby, wherein said metal grounding member is formed with a rigid metal plate configuration defining an edge portion bounding said substantially planar portion, said F antenna portion extending outward from said edge portion.

5. A planar inverted F antenna (PIFA) apparatus comprising:

an electronic unit having first and second housing members;

a metal grounding member having a substantially planar portion captured between said first and second housing members of said electronic unit; and, a plurality of peripherally projecting F antenna portions integrally formed with said metal grounding member, each said F antenna portion projecting in substantially coplanar manner from a periphery of said substantially planar portion of said metal grounding member to be secured to said electronic unit thereby;

wherein a pair of said F antenna portions extend from a common edge portion of said metal grounding member to be disposed in laterally spaced manner one relative to the other.

6. A planar inverted F antenna (PIFA) apparatus comprising:

an electronic unit having first and second housing members;

a metal grounding member having a substantially planar portion captured between said first and second housing members of said electronic unit; and, at least one peripherally projecting F antenna portion integrally formed with said metal grounding member, said F antenna portion projecting in substantially coplanar manner from a periphery of said substantially planar portion of said metal grounding member to be secured to said electronic unit thereby;

wherein said electronic unit is selected from the group consisting of: a desktop personal computer device, a notebook personal computer device, a tablet personal computer device, and a personal digital assistant device.

* * * * *